US009518595B2

(12) United States Patent
Selwyn

(10) Patent No.: US 9,518,595 B2
(45) Date of Patent: Dec. 13, 2016

(54) PULSED HYDRAULIC PRESSURE AMPLIFICATION SYSTEM

(71) Applicant: Frederick Philip Selwyn, Bude (GB)

(72) Inventor: Frederick Philip Selwyn, Bude (GB)

(73) Assignee: WATER POWERED TECHNOLOGIES (GB)

( * ) Notice: Subject to any disclaimer, the term of this patent is extended or adjusted under 35 U.S.C. 154(b) by 296 days.

(21) Appl. No.: 14/357,780

(22) PCT Filed: Nov. 22, 2012

(86) PCT No.: PCT/GB2012/052901

§ 371 (c)(1),
(2) Date: May 13, 2014

(87) PCT Pub. No.: WO2013/076498

PCT Pub. Date: May 30, 2013

(65) Prior Publication Data

US 2014/0298787 A1 Oct. 9, 2014

(30) Foreign Application Priority Data

Nov. 24, 2011 (GB) ..... 1120335.3

(51) Int. Cl.
*F15B 21/12* (2006.01)
*F04F 7/02* (2006.01)

(52) U.S. Cl.
CPC *F15B 21/12* (2013.01); *F04F 7/02* (2013.01)

(58) Field of Classification Search
CPC ..... F15B 21/12; F04F 7/02
USPC ..... 60/537; 417/225
See application file for complete search history.

(56) References Cited

U.S. PATENT DOCUMENTS 4,054,399 A * 10/1977 Maurer ..... F04F 7/02 137/517
4,371,036 A 2/1983 Fordsmand
4,489,750 A * 12/1984 Nehring ..... A61C 17/028 137/496
4,537,563 A * 8/1985 Ogawa ..... F04F 7/02 251/147
6,206,041 B1 * 3/2001 Selwyn ..... F04F 7/02 137/624.14
8,973,608 B2 * 3/2015 Selwyn ..... F04F 7/02 137/624.14

FOREIGN PATENT DOCUMENTS

DE 20 2088 006552 10/2008

* cited by examiner

*Primary Examiner* — Thomas E Lazo
(74) *Attorney, Agent, or Firm* — Galbreath Law Offices, P.C.; John A. Galbreath

(57) ABSTRACT

A hydraulic pressure amplification system for increasing the output pressure in the delivery pipe to or from a ram pump, a spring rebound inertia pump or similar cyclic pumps which deliver a pulsating flow. Said hydraulic pressure amplification system comprises a fluid inlet (29), a fluid outlet (30) and one or more rigid bodies (21) which contain an enclosed convolute passageway extending between the fluid inlet and the fluid outlet. The body or bodies are sandwiched between rigid cover plates (22,23) which respectively contain the fluid inlet (29) and the fluid outlet (30).

14 Claims, 6 Drawing Sheets

Fig. 1
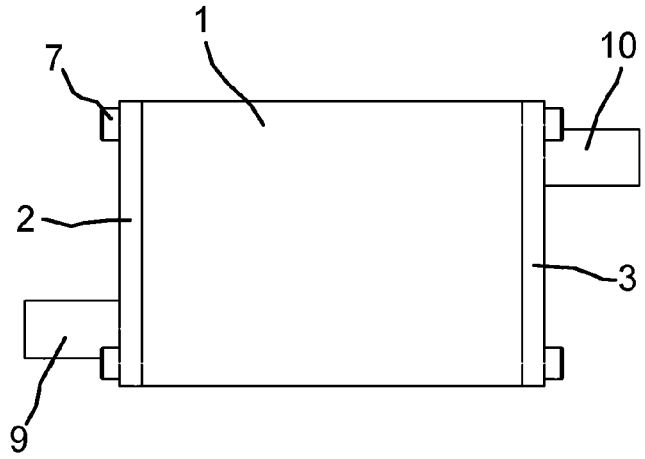
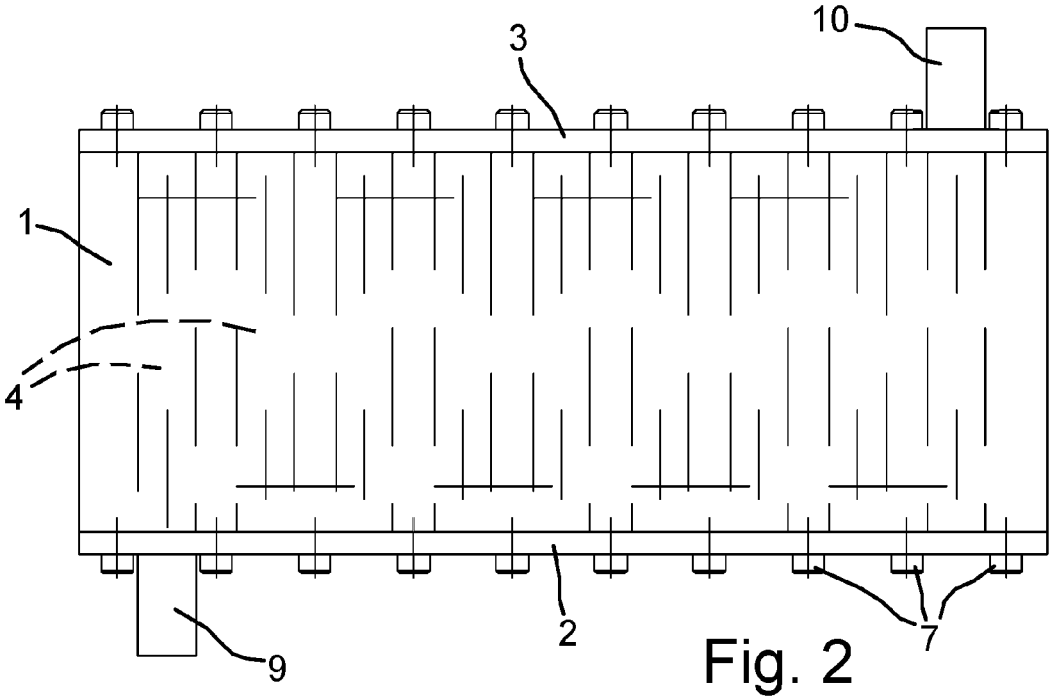
Fig. 2
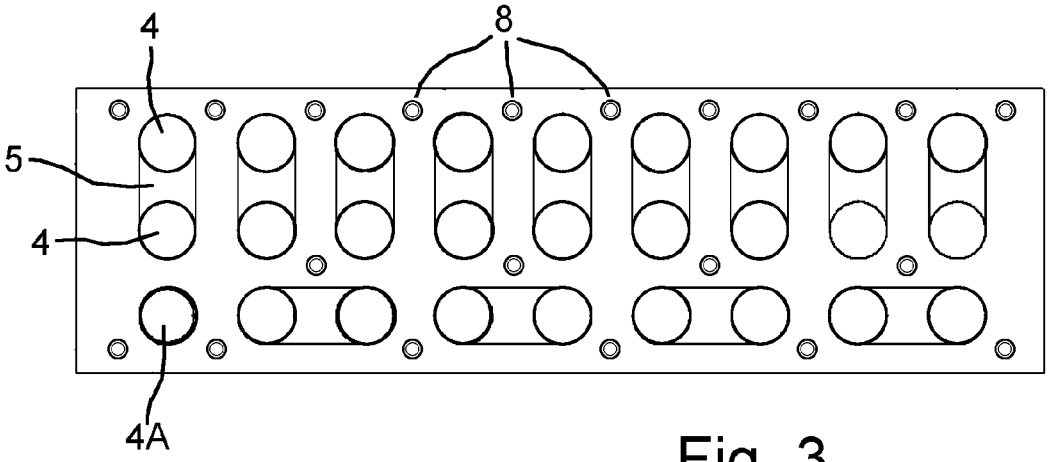
Fig. 3

PULSED HYDRAULIC PRESSURE AMPLIFICATION SYSTEM

TECHNICAL FIELD OF THE INVENTION

This invention relates to pulsed hydraulic pressure amplification systems of the kind which incorporate a ram-type pump, an oscillating valve pump, a spring rebound inertia pump, or similar pulsed pressure amplification device.

BACKGROUND

WO 2011 124 909 A1 discloses an adjustable fluid pressure amplifier which includes a chamber containing a resilient obturator ring arranged to co-operate with an annular exhaust aperture. Applied fluid pressure causes the ring to oscillate between conditions which alternately permit and prevent fluid from leaving the chamber through the exhaust aperture, causing a pulsed pressure increase in fluid flowing through a delivery outlet.

It is known that in systems which include such a pulsed pressure amplification device the flow characteristics depend to a large extent upon the volume of hydraulic fluid contained in the attached pipework. Since the length of the connecting pipes is usually determined by the physical layout of the installation, the operating parameters of the system are either fixed or are restricted to any adjustment provided by the pressure amplification device.

The present invention seeks to provide a new and inventive form of pulsed hydraulic pressure amplification system which allows greater control over the operating parameters without significantly increasing the size and complexity of the system.

SUMMARY OF THE INVENTION

The present invention proposes a pulsed hydraulic pressure amplification system characterised by a pressure matrix having a fluid inlet and a fluid outlet and a rigid expansion-resistant body which contains an enclosed convolute passageway extending between the fluid inlet and the fluid outlet.

The invention also provides a pressure matrix having an expansion-resistant body which comprises a matrix portion which forms an enclosed convolute passageway and a rigid outer portion which encloses the matrix portion.

The invention also provides a pressure matrix having a rigid outer portion which comprises a pair of end cheeks which hold a matrix portion between them.

The invention also provides a pressure matrix having end cheeks connected together by tie elements, e.g. bolts or machine screws.

The invention also provides a pressure matrix having tie elements inserted through a matrix portion.

The invention also provides a pressure matrix having a matrix portion which comprises a plurality of matrix bodies which each define a section of a convolute passageway.

The invention also provides a pressure matrix having matrix bodies which each comprise a single end wall and a side wall which defines a passageway section.

The invention also provides a pressure matrix having matrix bodies with a passageway section exposed at an open end of the body.

The invention also provides a pressure matrix having matrix bodies with an end wall which contains a single port which communicates with a passageway section.

The invention also provides a pressure matrix having matrix bodies with a passageway section which is substantially part-circular and extends through 270 degrees.

The invention also provides a pressure matrix having matrix bodies held together with an open end of one body covered by an end wall of an adjacent matrix body.

The invention also provides a pressure matrix having matrix bodies arranged in a stack between a pair of end cheeks.

The invention also provides a pressure matrix having a fluid inlet and outlet fixed to a rigid outer portion.

The invention also provides a pulsed hydraulic pressure amplification system having a plurality of pressure matrixes connected in series.

The invention also provides a pulsed hydraulic pressure amplification system having a pressure matrix connected to a port of an oscillating pump or fluid pressure amplifier.

BRIEF DESCRIPTION OF THE DRAWINGS

The following description and the accompanying drawings referred to therein are included by way of non-limiting example in order to illustrate how the invention may be put into practice. In the drawings:

FIG. 1 is an end view of a first pressure matrix for use in a pulsed hydraulic pressure amplification system in accordance with the invention;

FIG. 2 is a plan view of the pressure matrix;

FIG. 3 is a side view of the matrix body with its cover plate removed, looking from the left in FIG. 1;

DETAILED DESCRIPTION OF THE DRAWINGS

Figure 4:
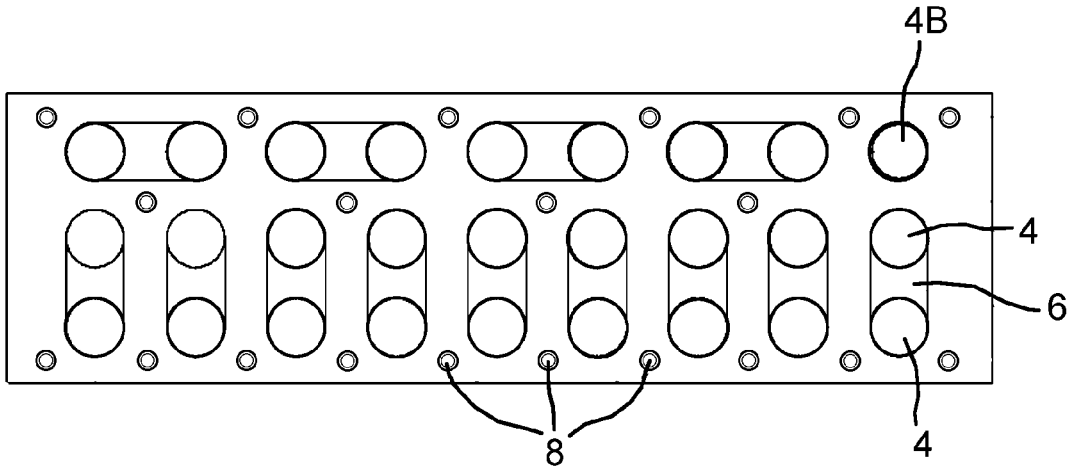
FIG. 4 is an opposite side view of the matrix body with the other cover plate removed.

Referring firstly to FIGS. 1 to 4, the pressure matrix comprises a solid inner matrix body 1 which is sandwiched between parallel outer cover plates 2 and 3, all of which may be formed of aluminium or other suitable rigid expansion-resistant materials. The matrix body is drilled with an odd number of parallel through-passages 4 (twenty seven in this example) which extend perpendicular to the cover plates 2 and 3. At one face, which is shown in FIG. 3, the passages 4 are joined together by interconnecting transverse channels 5, each of which connects a single pair of passages 4, leaving a single unpaired channel 4A. At the opposite face, shown in FIG. 4, different pairs of passages 4 are joined together by further interconnecting transverse channels 6, again leaving a single unpaired channel 4B. The cover plates 2 and 3 are sealingly fixed to the side faces by machine screws 7 which are received in threaded holes 8 in the matrix body. Cover plate 2 has a tubular inlet 9 which is aligned with the unpaired passage 4A, and cover plate 3 has a similar tubular outlet 10 aligned with the unpaired passage 4B. The passages 4 and interconnecting channels 5, 6 thus form a single convolute passageway extending between the inlet 9 and the outlet 10.

The pressure matrix is essentially a length of wide bore pressure resistant fluid conduit, but with the advantage that a relatively long length is contained within a very compact footprint.

When the matrix is used in a pulsed hydraulic pressure amplification system in the manner described below, for maximum effectiveness and efficiency it is essential that the passageway that contains the fluid is rigid and resistant to any movement and expansion. It is also important that the internal surfaces of the passageway are smooth and contoured to provide minimal fluid friction.

Whilst it is common for small diameter pipes to be formed into a coil to reduce their footprint area, this process becomes increasingly difficult with larger pipe diameters as the relative stresses in the material increase, causing the material to either fail or requiring the use of extreme pressures and treatments in the manufacturing process.

The pressure matrix provides a simple, low cost but effective solution.

The cavities which form the passageway within the matrix body may be either cast, machined or moulded.

The expansion forces exerted by fluid within the matrix are primarily resisted by the cover plates 2 and 3, so that the inner matrix body 1 could be formed of a lower strength material or fully enclosed within a high strength outer casing.

Figure 5:
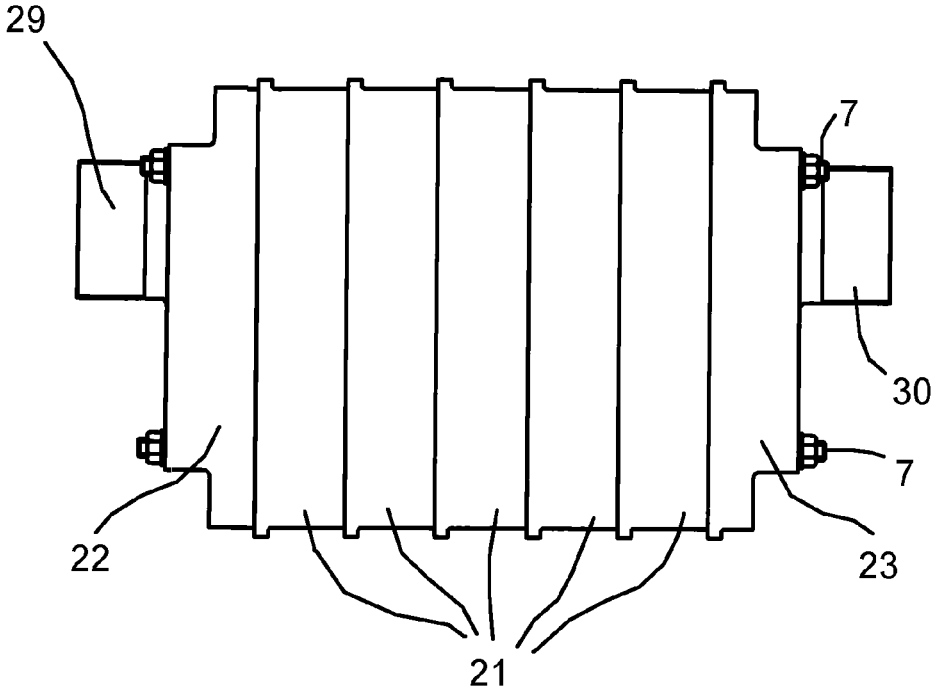
FIG. 5 is general view of a second pressure matrix for use in a pulsed hydraulic pressure amplification system in accordance with the invention.
Figure 6:
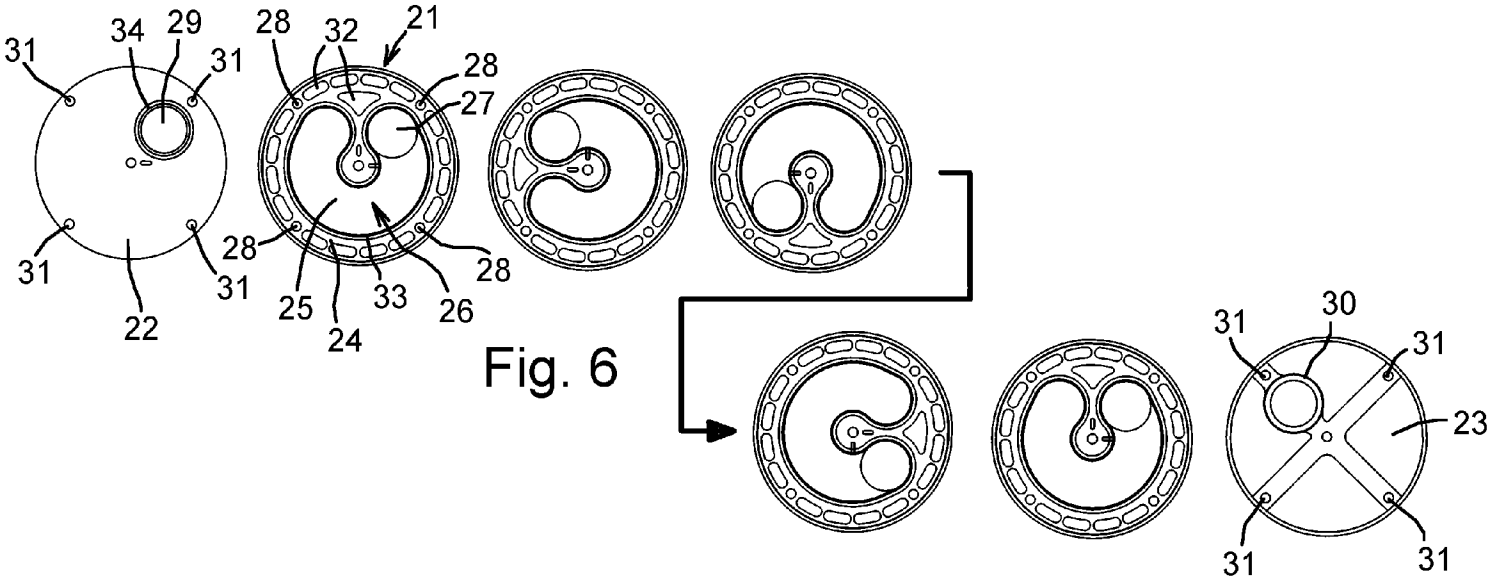
FIG. 6 is an exploded view of the second pressure matrix viewed generally from one end.
Figure 7:
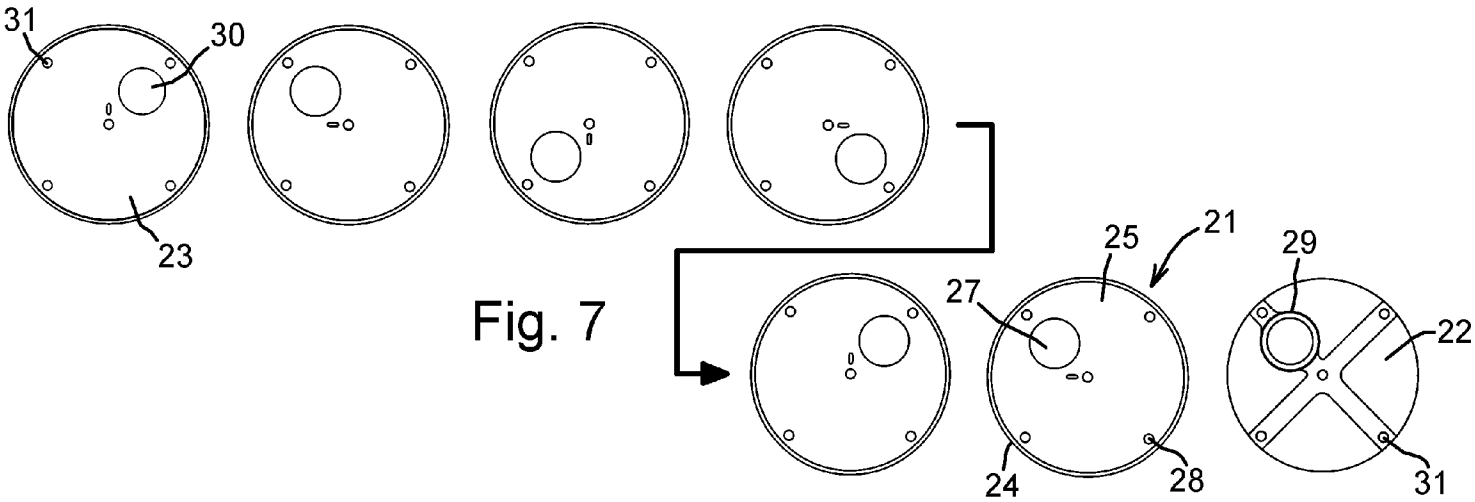
FIG. 7 is an exploded view of the second pressure matrix viewed from the opposite end.

In the pressure matrix described above the length of the passageway is fixed. However, FIGS. 5 to 7 show another form of pressure matrix which utilises a modular system in which a number of cast or moulded inner cavity units can be assembled to create a matrix of the desired internal length. The pressure matrix comprises a number of solid and substantially identical matrix bodies 21 (five in this example) which are sandwiched between parallel outer cover plates 22 and 23. Each matrix body 21 has a generally cylindrical side wall 24 with a single end wall 25 together defining a single part-circumferential passage 26 extending through about 270 degrees. The side wall 24 may incorporate cavities 32 to reduce material and weight whilst enhancing rigidity and strength. The passage 26 is open at the free end of side wall 24, but the end wall 25 closes the opposite end except for a single port 27 which opens into one end of the passageway. The outer surface of the side wall 24 is provided with four axially extending bolt holes 28 which are equally spaced at 90 degree intervals. The cover plates 22,23 are substantially identical, one having a tubular inlet 29 and the other having a tubular outlet 30. Four bolt holes 31 are provided at 90 degree intervals for alignment with the bolt holes 28.

The matrix bodies 21 are provided with interposed O-ring seals located in grooves 33 surrounding the passages 26. A further O-ring seal is inserted into a groove 34 surrounding the inlet 29 on the rear face of cover plate 22 to seal against the end wall 25 of the adjacent matrix body. The matrix bodies 21 and cover plates 22, 23 are joined together by high tensile bolts 7 inserted through the aligned holes 28 and 31. Each matrix body 21 is rotated through 90 degrees relative to the one immediately adjacent so that the port 27 of one body opens into the opposite end of the passage within the adjacent body. The inlet 29 is aligned with the port 27 of the adjacent matrix body so that the passages 26 and ports 27 thus form a single convolute passageway extending between the inlet 29 and the outlet 30. (It should be noted that in most cases the inlet and outlet can be reversed.) By varying the number of bodies 21 in each pressure matrix the length of the passageway can be adapted to the required length.

An advantage of this second form of pressure matrix is that the matrix or combination of matrixes can be assembled to suit any particular requirement and the manufacturing costs of the units can be reduced. Another advantage is simplicity, as the system can be assembled without special skills or tools from a small number of standard parts.

Using standard modular components also enables them to be designed to provide good mechanical and flow enhancing properties which are consistently reproducible. This system is also advantageous for ease of transportation as well as the ability to dissemble the matrix for cleaning purposes etc.

It should be noted that the expansion forces exerted by fluid within the matrix are primarily resisted by the end plates 22 and 23 together with their connecting bolts.

Figure 13:
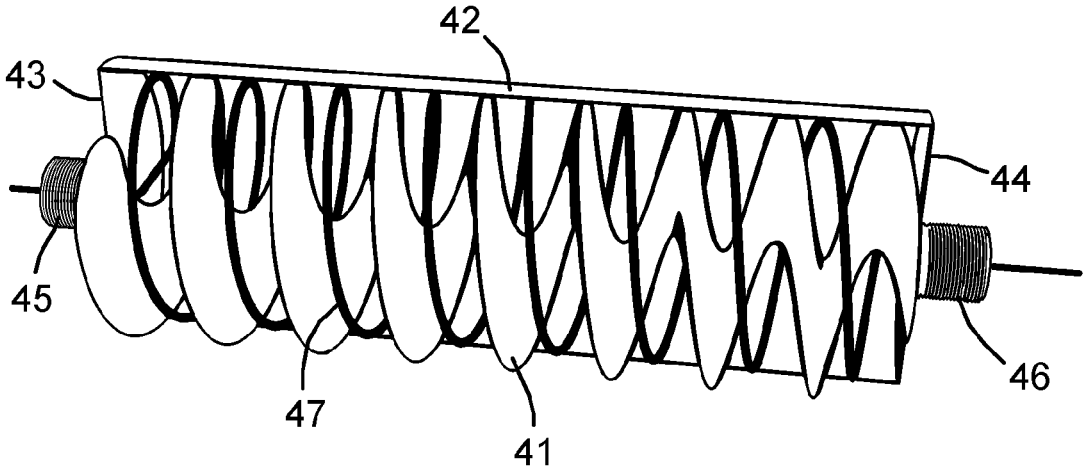
FIG. 13 is a general view of a third pressure matrix, shown partially cut away for clarity, for use in a pulsed hydraulic pressure amplification system in accordance with the invention.

A third form of pressure matrix is shown in FIG. 13. The pressure matrix comprises an inner matrix body 41 which is in the form of a helical screw. The matrix body is contained within a rigid cylindrical outer casing 42 provided with end plates 43 and 44, having respective tubular inlets and outlets 45, 46. The inner screw 41 co-operates with the outer casing 42 to define a single helical passageway 47 extending between the inlet and outlet. (Again, the inlet and outlet can be reversed.)

The helical screw and outer casing could both be fabricated from sheet steel. It should however be noted that the expansion forces exerted by fluid within the pressure matrix are primarily resisted by the outer casing 42, and the inner screw 41 could be formed of a lower strength material, such as a plastic moulding.

Figure 8:
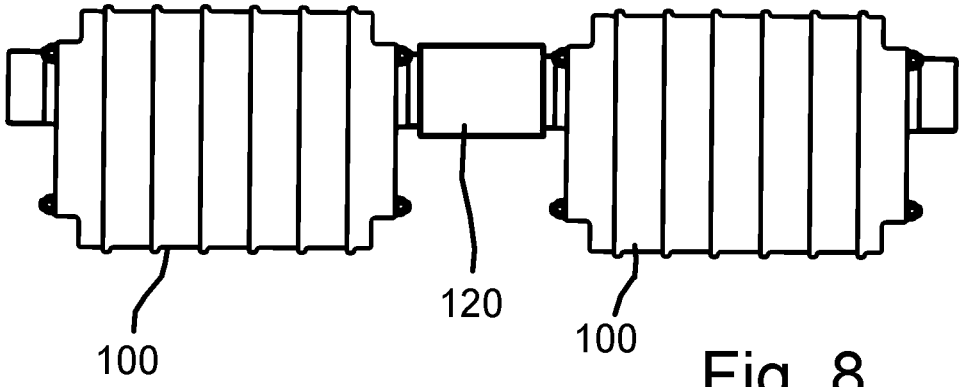
FIG. 8 shows how two of the pressure matrixes can be connected to double the effective length.
Figure 9:
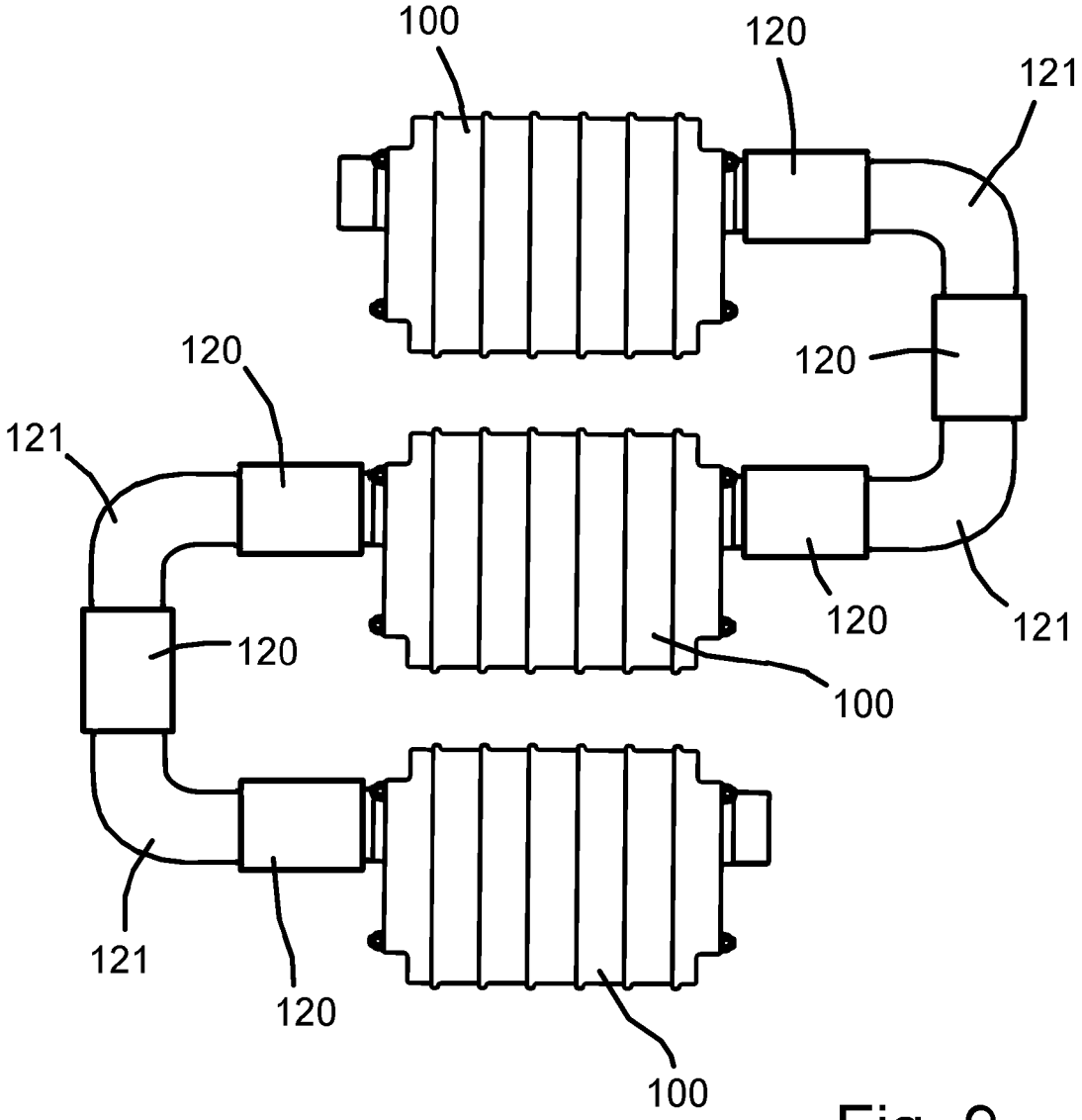
FIG. 9 shows how three of the pressure matrixes can be connected together.

In a pulsed hydraulic pressure amplification system it is possible to increase the effective operating length of a pressure matrix by connecting two or more of the pressure matrixes in series. For example, two pressure matrixes can be joined by a straight coupler 120 as in FIG. 8. The matrixes can also be connected by straight couplers 120 and elbows 121 as in FIG. 9 to provide a very compact configuration.

The principal use of the pressure matrix in a pulsed hydraulic pressure amplification system is to effectively extend the length of the attached pipe so that when the pump valve or obturator closes, the volume and hence momentum of the fluid contained within the pipe system (pipe and matrix) is increased beyond that of the pipe alone.

Figure 10:
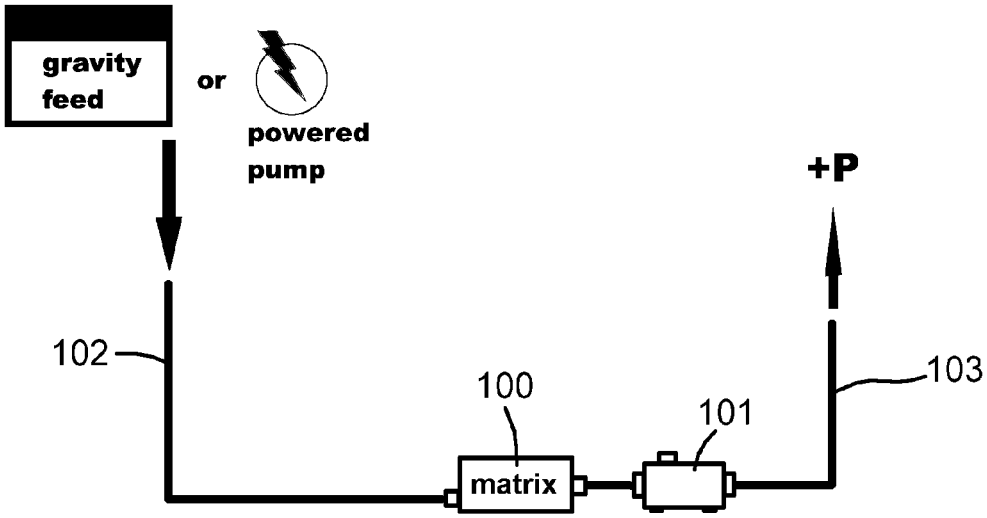
FIG. 10 is pulsed hydraulic pressure amplification system in accordance with the invention which incorporates the pressure matrix.

FIG. 10 shows how the present pressure matrix 100 can be used in a pulsed hydraulic pressure amplification system to provide an enhanced pressure increase when installed prior to the inlet of a pump 101 such as the fluid pressure amplifier described in WO 2011 124 909 A1. The pressure matrix increases the effective length of the supply pipe 102 so that when the pump obturator valve closes the mass and momentum of fluid is greater, thereby increasing the pressure in the delivery pipe 103. The matrix also provides the ability to vary the natural operating frequency of the system and thereby increase efficiency. The longer the effective pipe length, the slower will be the pump frequency due to the longer time required for the fluid to reach the same velocity and hence close the obturator. There are optimum values of frequency and flow which will result in maximum system efficiency which can be achieved by tuning the pipe lengths. The pressure matrix of FIGS. 5 to 7 easily allows this tuning to be achieved without incurring long lengths of pipework.

Figure 11:
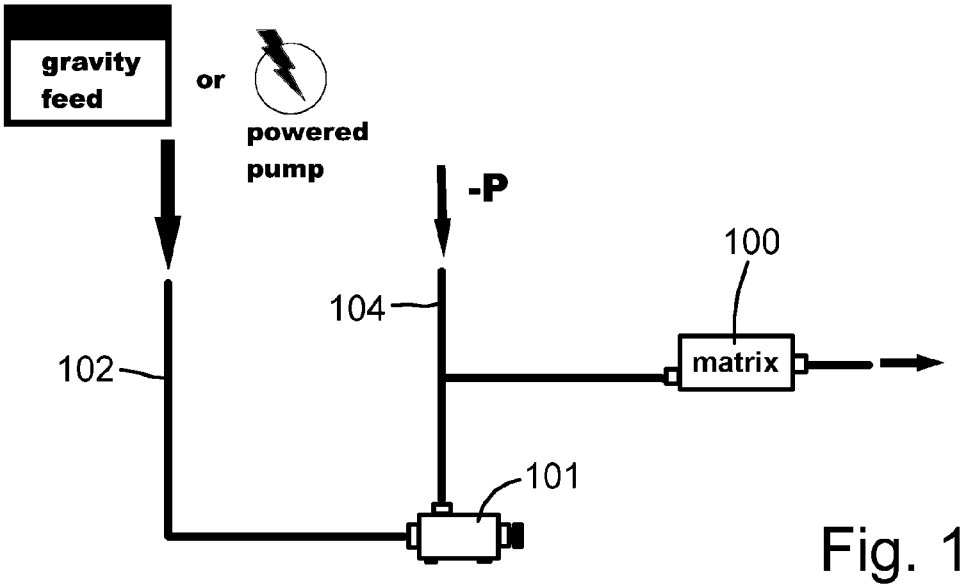
FIG. 11 is another configuration of the pressure amplification system.

When installed on the exhaust port 104 of such a system as in FIG. 11, an enhanced negative pressure can be achieved by the same effect. Varying the effective length of the exhaust pipe will allow such a system to be tuned so that conditions of maximum pressure and/or efficiency can be obtained.

Figure 12:
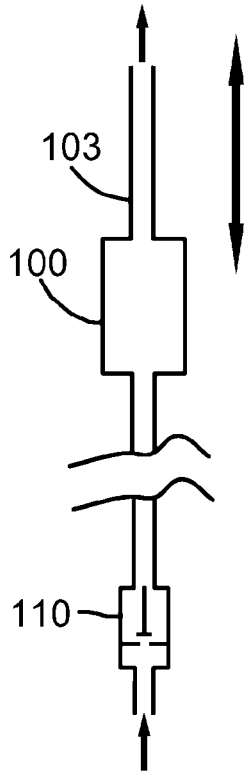
FIG. 12 is a different form of pulsed hydraulic pressure amplification system in accordance with the invention.

FIG. 12 shows another use of the pressure matrix 100 in a pulsed hydraulic pressure amplification system to increase the output pressure in the delivery pipe 103 of an oscillating well or borehole pump 110.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A pulsed hydraulic pressure amplification system characterised by a pressure matrix having a fluid inlet and a fluid outlet (9, 10; 29, 30; 45, 46) and a rigid expansion-resistant body which contains an enclosed convolute passageway (4; 26; 47) extending between the fluid inlet and the fluid outlet, and wherein the expansion-resistant body comprises a matrix portion (1; 21; 41) which forms the enclosed convolute passageway (4; 26, 47) and a rigid outer portion (2, 3; 22, 23; 42) which encloses the matrix portion.

2. A pulsed hydraulic pressure amplification system according to claim 1 in which the rigid outer portion comprises a pair of end cheeks (2, 3; 22, 23) which hold the matrix portion (1; 21) between them.

3. A pulsed hydraulic pressure amplification system according to claim 2 in which the end cheeks (2, 3; 22, 23) are connected together by tie elements, e.g. machine screws (7).

4. A pulsed hydraulic pressure amplification system according to claim 3 in which the tie elements (7) are inserted through the matrix portion (1; 21).

5. A pulsed hydraulic pressure amplification system according to claim 1 in which the matrix portion comprises a plurality of matrix bodies (21) which each define a section (26) of the convolute passageway.

6. A pulsed hydraulic pressure amplification system according to claim 5 in which the matrix bodies each comprise a single end wall (25) and a side wall (24) which defines the passageway section (26).

7. A pulsed hydraulic pressure amplification system according to claim 6 in which the passageway section (26) is exposed at an open end of the body.

8. A pulsed hydraulic pressure amplification system according to claim 6 in which the end wall (25) contains a single port (27) which communicates with the passageway section (26).

9. A pulsed hydraulic pressure amplification system according to claim 7 in which the matrix bodies (21) are held together with the open end of one body covered by the end wall (25) of an adjacent matrix body.

10. A pulsed hydraulic pressure amplification system according to claim 5 in which the passageway section (26) is substantially part-circular and extends through 270 degrees.

11. A pulsed hydraulic pressure amplification system according to claim 5 in which the matrix bodies (21) are arranged in a stack between a pair of end cheeks (22, 23).

12. A pulsed hydraulic pressure amplification system according to claim 1 in which the fluid inlet and outlet (9, 10; 29, 30; 45, 46) are fixed to the rigid outer portion (2, 3; 22, 23; 42).

13. A pulsed hydraulic pressure amplification system according to claim 1 which includes a plurality of pressure matrixes (100) connected in series.

14. A pulsed hydraulic pressure amplification system according to claim 1 in which the pressure matrix (100) is connected to a port of an oscillating pump (110) or fluid pressure amplifier (101).

* * * * *